United States Patent [19]

Bouve

[11] 4,148,487

[45] Apr. 10, 1979

[54] SURFACE GAME TARGET APPARATUS

[76] Inventor: Thomas T. Bouve, 5419 Lambeth Rd., Bethesda, Md. 20014

[21] Appl. No.: 824,823

[22] Filed: Aug. 15, 1977

[51] Int. Cl.[2] ..... A63B 71/06

[52] U.S. Cl. ..... 273/127 B; 273/123 R; 273/147 B; D21/8

[58] Field of Search ..... 273/14, 127 R, 95 D, 273/3 C, 67 R, 2 C, 12, 85 E, 95 R, 95 F, 113, 115, 118 R, 123 R, 129 R, 129 B, 129 BH, 176 F, 176 FA, 176 FB, 178 R, 178 B, 178 A, 179 R, 179 A, 179 B, 179 C, 179 D, 179 E, 180, 127 C, 127 B; D34/5 NN

[56] References Cited

U.S. PATENT DOCUMENTS

| | | | |
|---|---|---|---|
| 141,398 | 5/1945 | Welsh | D34/5 NN |
| 143,838 | 2/1946 | Marr | D34/5 NN |
| 161,248 | 12/1950 | Darr | D34/5 NN |
| 1,094,236 | 4/1914 | Minshall | D34/5 NN |
| 1,656,739 | 1/1928 | Kurtz | D34/5 NN |
| 2,140,082 | 12/1938 | Klinger | 273/123 R |
| 3,761,090 | 9/1973 | Nelson | 273/127 B |

FOREIGN PATENT DOCUMENTS

| | | | |
|---|---|---|---|
| 563496 | 12/1923 | France | 273/14 |

*Primary Examiner*—William H. Grieb
*Assistant Examiner*—T. Brown
*Attorney, Agent, or Firm*—Oblon, Fisher, Spivak, McClelland & Maier

[57] ABSTRACT

A game board, positioned on any level surface, onto which balls are rolled which includes a sloped planar surface provided with a plurality of holes and having a front linear edge portion, a side border substantially surrounding an outer edge of the surface and displaced above the surface, the side border being horizontally and vertically contoured to form a U-shaped inclined border around a side and back portion of the side border, and an inclined edge planar surface connected to the linear edge portion joined by a front plated border such that a ball which is rolled onto the planar surface subsequently rolls off of the game boards should the ball fail to become lodged within one of the holes or fail to become deflected or obstructed by the front plated border or by the combined effect of a lodged ball and its adjacent portion of the side border.

3 Claims, 11 Drawing Figures

SURFACE GAME TARGET APPARATUS

BACKGROUND OF THE INVENTION

1. Field of the Invention:

This invention relates to a game board with a unique contour and plated design for controlling ball movement for balls rolled upon the surface of the game board wherein a player rolls balls one at a time onto the playing board in an attempt to land each of the balls in one of a plurality of holes provided in the game board.

2. Description of the Prior Art:

The present invention is distinguishable from previous types of game boards in that the game board border of the present invention, for example, utilizes a unique contour and plated design which is an integral part of the game in that it largely controls ball movement and can result in a displacement of one or more balls between the game board and the player. Moreover, the present invention is also characterized in the specific position of the holes provided in the game board.

SUMMARY OF THE INVENTION

An object of this invention is to utilize a game board which is provided with a plurality of holes and has a border with a unique contour and plated design for controlling ball movement.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
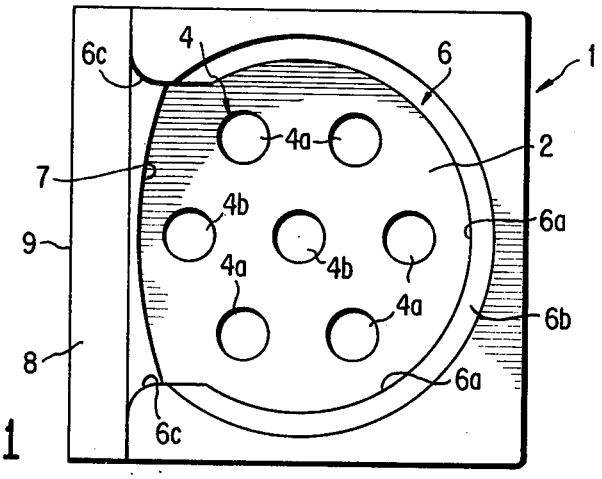
FIG. 1 is a top plan view of the invention.

The invention will be described in greater detail hereinafter with reference to FIG. 1 and FIG. 2. The Roly-Poly game is indicated by reference numeral 1 includes a game board planar surface 2 which is provided with a plurality of holes or cylindrical indentations 4 with perimeter holes **4*a* and front center holes 4*b*. A side border 6 substantially surrounds the back and side portions of game board planar surface 2 and is elevated and inclined from the level of planar surface 2 to provide a raised border. Side border 6 includes side border contour 6*a* which is horizontally contoured to form a U-shaped border around which balls roll. Side border contour 6*a*** channels an unobstructed rolling ball off of the game board so that it comes to rest in the path of the next rolled ball.

Side border 6 also includes side border vertical contour **6*b* which is contoured to form an inclined border which provides a deflecting surface for a ball which is rolled and strikes side border 6. Side border contour 6*b* and a lodged ball in one of holes 4*a* form a track configuration which provides a deflecting constriction for balls riding up and over the configuration. FIG. 2 illustrates the deflecting constriction upon played ball 14 by side border vertical contour 6*b* and lodged ball 15. Each ball has a diameter and said perimeter holes are displaced such that a distance between the surface of a lodged ball to side border 6 is less than d in length so that a ball in passage between a lodged ball as shown in FIG. 2 will tend to ride up on the surface of lodged ball 15 and the surface of side border vertical contour 6*b* resulting either in a reversal of direction of movement of ball 14 or continuation of the original direction of movement depending upon the speed of ball movement. Side border 6 also includes a protruding contour 6*c* on either side of the front portion of side border 6 and provides an angular deflecting surface. Front plated border 7 mounted on the front portion of the game board planar surface 2 delineates the front horizontal edge of game board planar surface 2 and provides a directional deflecting surface affecting balls rolling from the rear to the front of game board planar surface 2** and provides an obstructing curved surface directing non-lodged balls remaining on the gameboard toward the front center of the gameboard.

An inclined edge surface 8 is also connected to the front portion of planar surface 2 and extends between protruding vertical plane contour surface **6*c* of side border 6. Inclined surface 8 also is provided with a front edge portion 9 which, in turn, forms the front edge of game 1. Inclined edge surface 8 is provided with slope angle b while planar surface 2 is also provided with a slope angle a. The change in slope angle from angle b to angle a takes place along front plated border 7 which forms the line of intersection of planar surface 2 and inclined edge surface 8**.

Figure 2:
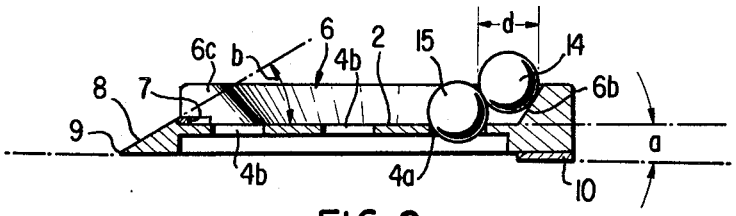
FIG. 2 is a side cross-sectional view of FIG. 1 and illustrates a specialized aspect of ball movement.

Holes **4*a* are directly adjacent to side border 6 as shown in FIG. 1. Holes 4*b* are located in the center and at the front center of game board planar surface 2 as also shown in FIG. 1. Support element 10 causes game 1** to be tilted slightly toward the front with respect to a level surface to cause a slight incline toward the rear and form slope angle a.

The object of the Roly-Poly game is that, once the game board has been placed on a level surface, such as a floor or a billiard table, a player rolls wooden, composition or billiard balls one at a time onto the game board so that each ball lands in a hole which is designated as being worth the highest possible score in order to maximize the total point count. The player with the highest score at the end of five rounds wins the game. The key elements of Roly-Poly are the positions of played balls and subsequent movement caused by the collision of rolled balls as well as direction and speed of ball movement.

Figure 3:
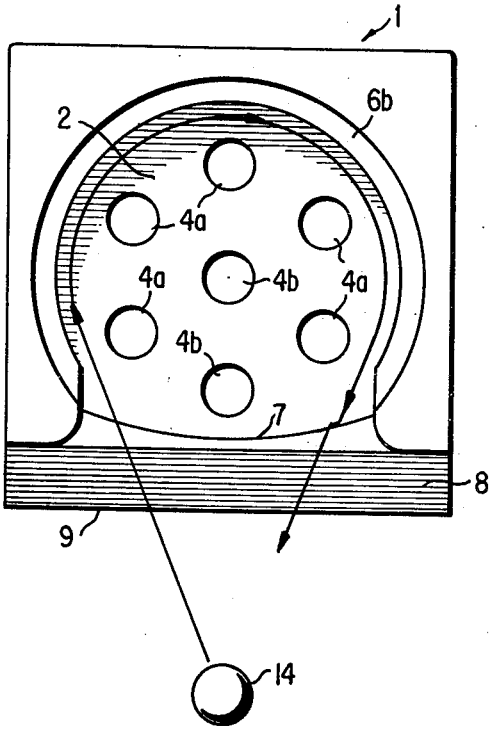
FIGS. 3–11 show the relationship of the gam board border to ball movement.

The rules and description of the game are such that five balls are used, three of which are red and count the score of the hole in which they land, another of which is white and counts double that of the red balls, and another of which is black and counts one-half that of the red balls. Ball movement will be described in detail hereinafter with reference to FIGS. 3–11. A ball rolled in the path between the player and the game board must remain there until the player is finished rolling the balls. A rolled ball may be so located in the path as a result of rolling off of the game board or by not reaching the game board when it was originally rolled. The player has the option of trying to hit the obstructing ball back onto the game board with another ball or rolling a ball around the obstructing ball positioned as shown in FIG. 3. Handicaps can be made either by allowing an inexperienced player to be closer to the game board when rolling than the other players or having experienced players use less than five billiard balls. Each player, however, normally receives five turns.

The unique contour and plated design of side border 6 and front plated border 7 is an integral part of the game in that it largely controls the ball movement. As shown in FIG. 3, a played ball 14 which does not land in any of holes 4 will tend to roll around side border contour *6a*, and will roll off of the game board in the direction determined by side border contour *6a* unless deflected or obstructed by front plated border 7 or by the combined effect of side border vertical contour *6b* and a lodged ball in one of holes *4a*. If a ball rolls off of the game board, the ball will normally tend to cease rolling directly in the path between the player and the game board and, consequently, ball 14 will become an obstruction for the next ball to be rolled. The obstruction thus created will progressively worsen as more played balls roll off the gameboard. Moreover, to negotiate a ball around an obstruction formed of one or more balls, or as a particular ball rolling strategy, a player may roll a ball towards the left or right protruding contour *6c*.

Figure 4:
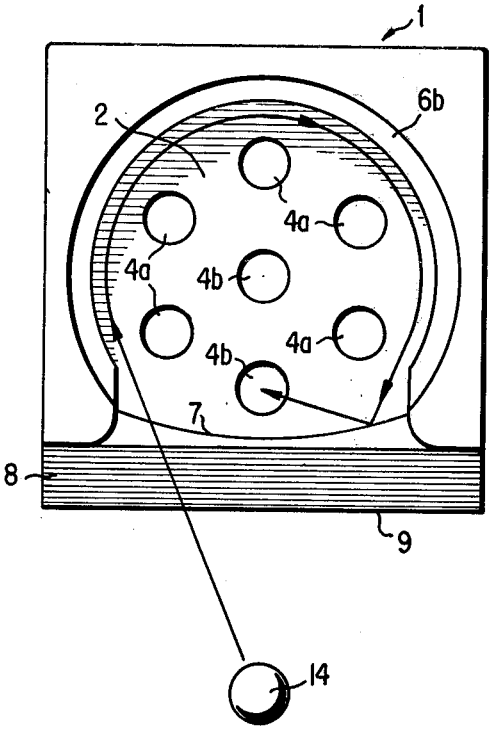
Figure 5:
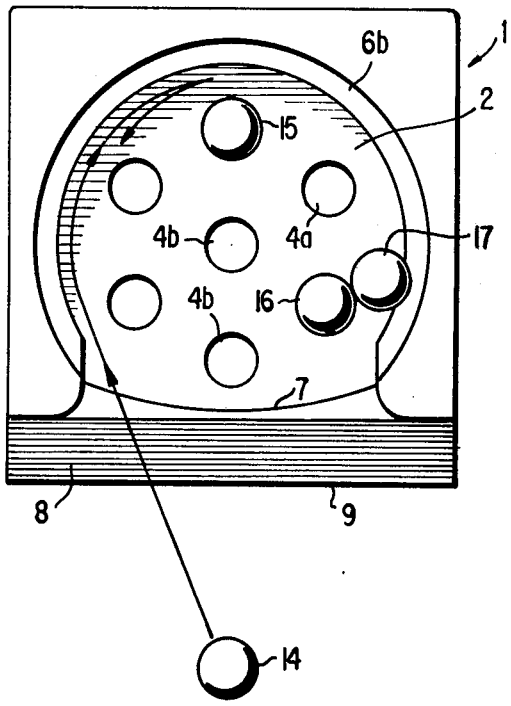
Figure 6:
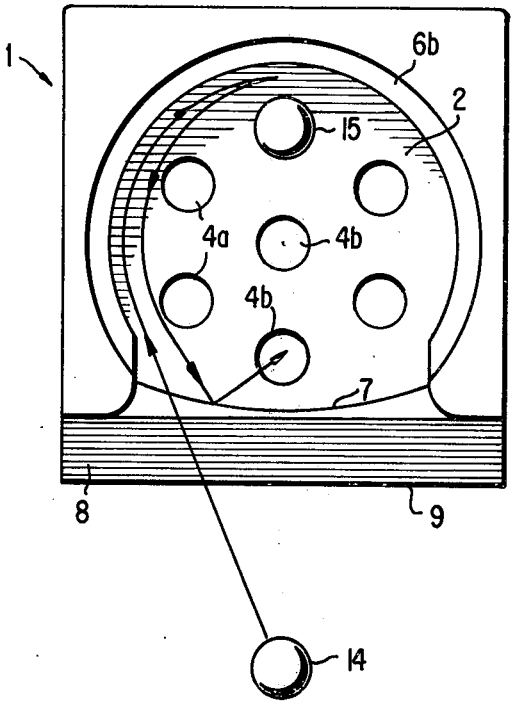
Figure 7:
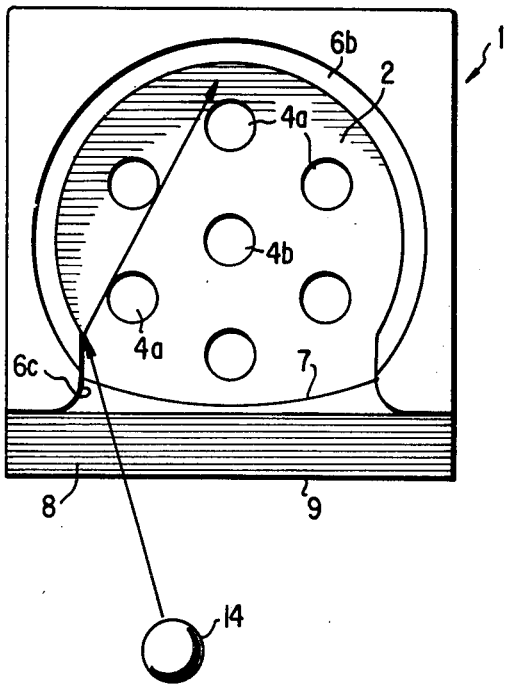
Figure 8:
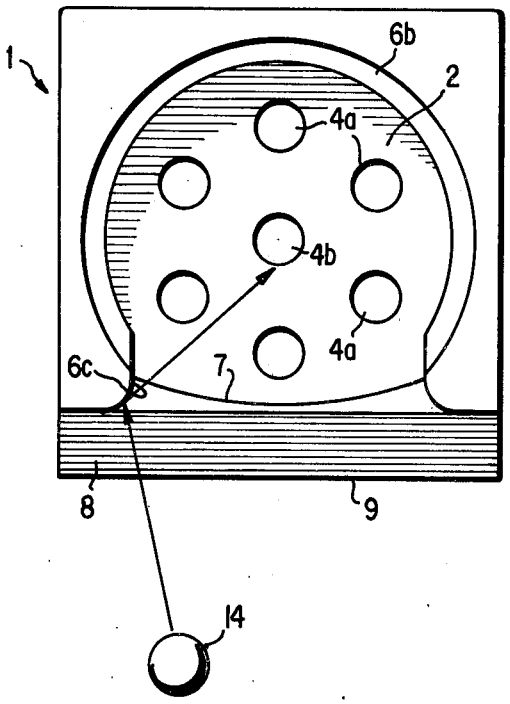
Figure 9:
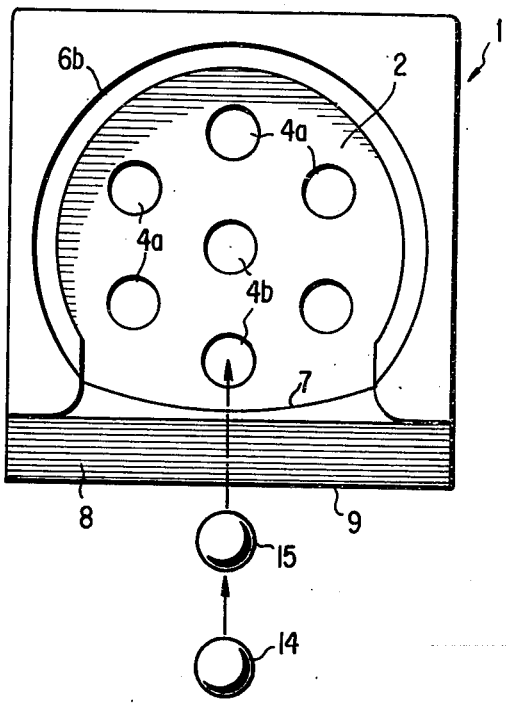
Figure 10:
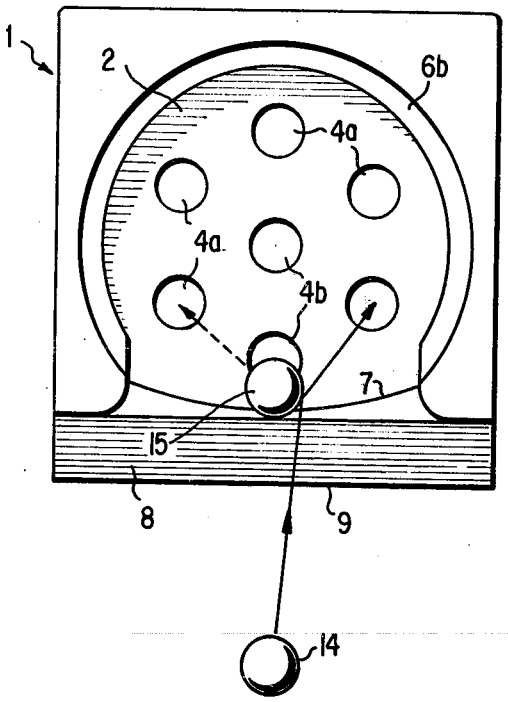
Figure 11:
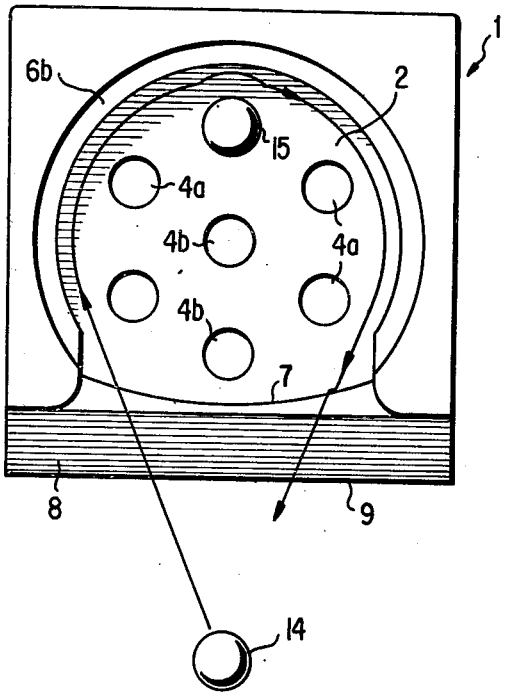

FIGS. 4–10 illustrate various singular and multiple ball movements as follows: FIG. 4 — deflection of ball 14 movement by front plated border 7; FIG. 5 — deflection of ball 14 movement by side border vertical contour *6b* and lodged ball 15; and obstruction of stationary ball 17 by lodged ball 16; FIG. 6 — multiple deflection of ball 14 movement by both side border vertical contour *6b* and lodged ball 15 and front plated border 7; FIG. 7 — deflection of ball 14 movement by striking the back portion of protruding contour *6c;* FIG. 8 — deflection of ball 14 movement by striking the forward portion of protruding contour *6c;* FIG. 9 — multiple ball movement caused by ball 14 striking previously played ball 15 off the board; FIG. 10 — multiple ball movement caused by ball 14 striking previously played ball 15 on the board, obstructed and positioned by front plated border 7; and FIG. 11 — ball 14 movement of sufficient speed to overcome obstruction of lodged ball 15 and the side border contour portion.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A game board, positioned on any level surface, onto which balls are rolled which comprises:

a plurality of balls;

a sloped planar surface with a first slope angle, provided with a plurality of holes, having a front linear edge portion;

a side border substantially surrounding an outer edge of said surface and displaced above said surface, said side border being contoured to form a U-shaped inclined border around a side and back portion of said side border;

an inclined edge planar surface with a second slope angle connected to said linear edge portion wherein a first ball rolled onto said planar surface subsequently rolls off of said game board should said ball fail to become lodged within one of said holes or become otherwise obstructed so as to be located between a player location and the game board; and a front plated border mounted on said sloped planar surface forming a curved line of intersection between said sloped planar surface and said inclined edge planar surface, which interconnects said first and said second contour surface such that a rolled ball which gently strikes said front plated border is deflected towards the rear portion of said sloped planar surface and can become lodged against said front plated border positioned near the front center of said sloped planar surface.

2. A game board as set forth in claim 1, which further comprises:

first and second protruding contour surfaces connected to said side border and said inclined edge planar surface such that a rolled ball which strikes said first or said second protruding contour is deflected towards a rear or side portion of said sloped planar surface.

3. A game board as set forth in claim 1, wherein each of said balls have a diameter d and said holes include perimeter holes having a diameter of less than d which are displaced such that a distance between the surface of a lodged ball adjacent to the side border and the side border surface is less than d and such that a ball in passage between the said lodged ball and the side border will ride up on said ball surface and said side border surface resulting either in a reversal of direction of movement of said ball or continuation of the original direction of movement depending upon the speed of ball movement.

* * * * *